US011453549B1

(12) United States Patent
Issa

(10) Patent No.: US 11,453,549 B1
(45) Date of Patent: Sep. 27, 2022

(54) BIN BAG DISPENSER

(71) Applicant: Abdullah Issa, Melbourne (AU)

(72) Inventor: Abdullah Issa, Melbourne (AU)

( * ) Notice: Subject to any disclaimer, the term of this patent is extended or adjusted under 35 U.S.C. 154(b) by 0 days.

(21) Appl. No.: 17/555,864

(22) Filed: Dec. 20, 2021

(51) Int. Cl.
*B65F 1/06* (2006.01)
*B65D 33/00* (2006.01)
*B65D 83/08* (2006.01)

(52) U.S. Cl.
CPC ..... *B65F 1/062* (2013.01); *B65D 33/002* (2013.01); *B65D 83/0805* (2013.01)

(58) Field of Classification Search
CPC ..... B65D 90/046; B65D 83/0805; B65D 33/002; B65F 1/06; B65F 1/062
USPC ..... 220/495.07
See application file for complete search history.

(56) References Cited

U.S. PATENT DOCUMENTS

| | | | | |
|---|---|---|---|---|
| 5,322,180 | A | 6/1994 | Ker | |
| 5,353,950 | A | 10/1994 | Taylor et al. | |
| 5,678,723 | A | 10/1997 | Swift et al. | |
| 6,193,095 | B1 | 2/2001 | McNeil | |
| 6,199,714 | B1 | 3/2001 | Thompson | |
| 6,283,405 | B1 | 9/2001 | Tracy | |
| 7,168,591 | B1 | 1/2007 | Miller | |
| 7,422,126 | B2 * | 9/2008 | Ceschi | B65D 33/002 220/495.07 |
| 8,522,999 | B2 | 9/2013 | Licata | |
| 8,807,379 | B1 * | 8/2014 | Hammond | B65F 1/062 220/495.07 |
| 9,771,215 | B2 | 9/2017 | Rogers | |
| 9,850,064 | B2 * | 12/2017 | Egan | B65F 1/062 |
| 10,329,115 | B2 | 6/2019 | Licata | |
| 10,889,434 | B2 | 1/2021 | Mandelbaum | |
| 2005/0029281 | A1 | 2/2005 | Westermann et al. | |
| 2005/0092753 | A1 | 5/2005 | Best | |
| 2008/0083757 | A1 | 4/2008 | Parker et al. | |
| 2009/0302041 | A1 | 12/2009 | Wolfson et al. | |
| 2010/0276428 | A1 | 11/2010 | Lord et al. | |
| 2015/0321841 | A1 | 11/2015 | Salas et al. | |
| 2015/0375920 | A1 | 12/2015 | Hammond | |
| 2017/0197782 | A1 | 7/2017 | Reith | |
| 2018/0044108 | A1 | 2/2018 | Ackerman | |

* cited by examiner

*Primary Examiner* — King M Chu
(74) *Attorney, Agent, or Firm* — Eric Karich; Karich & Associates

(57) ABSTRACT

A bin bag dispenser has a dispenser housing having a housing base and a housing wall that extends upwardly from the housing base to form a chamber for holding the trash bag roll; and a housing cover that fits over the dispenser housing to cover the chamber, the housing cover having a top panel and a front surface. A dispensing mechanism is mounting in the top panel of the housing cover, the dispensing mechanism having an annular retainer fixedly mounted to the top panel, a resilient sheet having a slit, and a means for mounting the resilient sheet within the annular retainer so that trash bags from the trash bag roll may be dispenser though the slit of the dispensing mechanism.

5 Claims, 4 Drawing Sheets

BIN BAG DISPENSER

BACKGROUND OF THE INVENTION

Field of the Invention

This invention relates generally to dispensers, and more particularly to a dispenser for dispensing bin bags.

Description of Related Art

The prior art teaches various forms of dispensers for dispensing bin bags (aka trash bags).

Miller, U.S. Pat. No. 7,168,591, teaches a trash bag dispenser that includes a housing for containing trash bags, and a cover having a slot therein for guiding the trash bag therethrough. The cover is movably connected to the housing and integral therewith for allowing the cover to capture the trash bag and to allow the trash bag to freely move when urged through the slot. The trash bag dispenser is attachable to an interior of the trash receptacle with an adhesive backed hook and loop type fastener.

Similar devices are also shown in Licata, U.S. Pat. No. 8,522,999, Tracy, U.S. Pat. No. 6,283,405, and Thompson, U.S. Pat. No. 6,199,714.

The prior art teaches dispensers for dispensing bin bags. However, the prior art does not teach a bin bag dispenser having the improvements described herein. The present invention fulfills these needs and provides further advantages as described in the following summary.

SUMMARY OF THE INVENTION

The present invention teaches certain benefits in construction and use which give rise to the objectives described below.

The present invention provides a bin bag dispenser for holding a trash bag roll on a bottom of a trash bin. The bin bag dispenser includes a dispenser housing having a housing base and a housing wall that extends upwardly from the housing base to form a chamber for holding the trash bag roll; and a housing cover that fits over the dispenser housing to cover the chamber, the housing cover having a top panel and a front surface. A dispensing mechanism is mounting in the top panel of the housing cover, the dispensing mechanism having an annular retainer fixedly mounted to the top panel, a resilient sheet having a slit, and a means for mounting the resilient sheet within the annular retainer so that trash bags from the trash bag roll may be dispenser though the slit of the dispensing mechanism.

A primary objective of the present invention is to provide a bin bag dispenser having advantages not taught by the prior art.

Another objective is to provide a bin bag dispenser that may be readily mounted in the bottom of the trash bin for dispensing bin bags for use in the trash bin.

A further objective is to provide a bin bag dispenser that may easily dispense bin bags (aka trash bags) at the point of use, so they are always conveniently placed.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a bin bag dispenser for holding a trash bag roll on a bottom of a trash bin.

Figure 1:
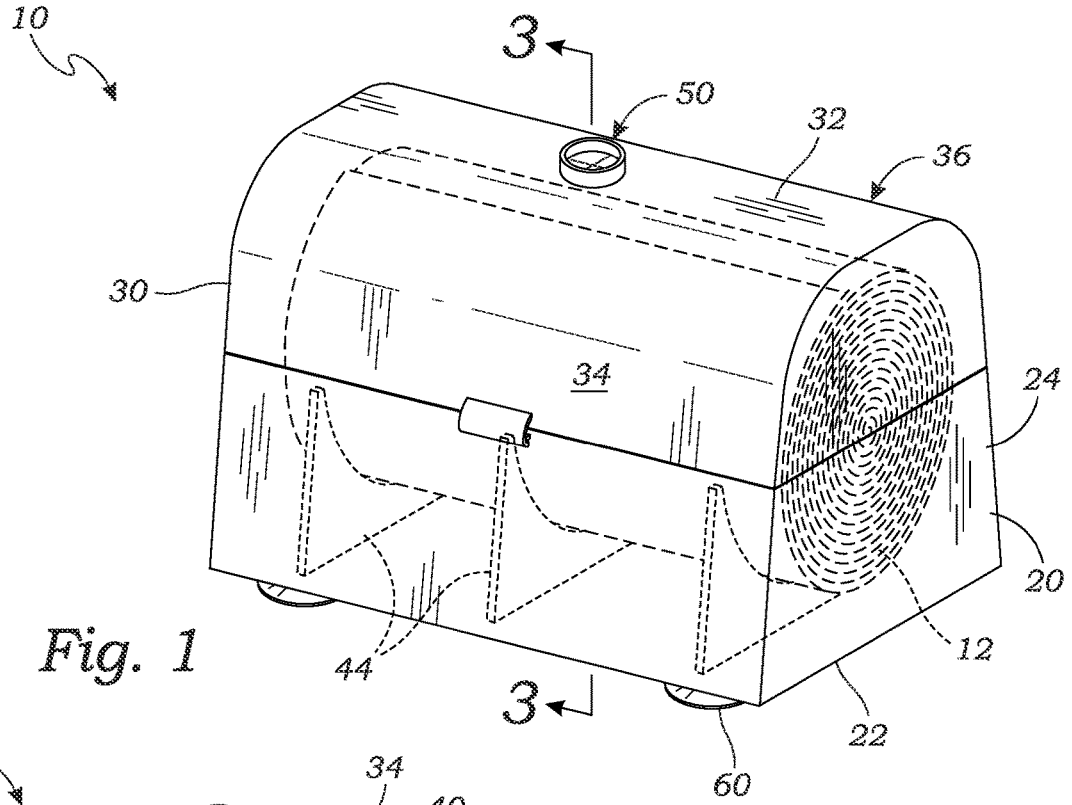
FIG. 1 is a perspective view of a bin bag dispenser according to one embodiment of the present invention, illustrating the bin bag dispenser in a closed position.
Figure 2:
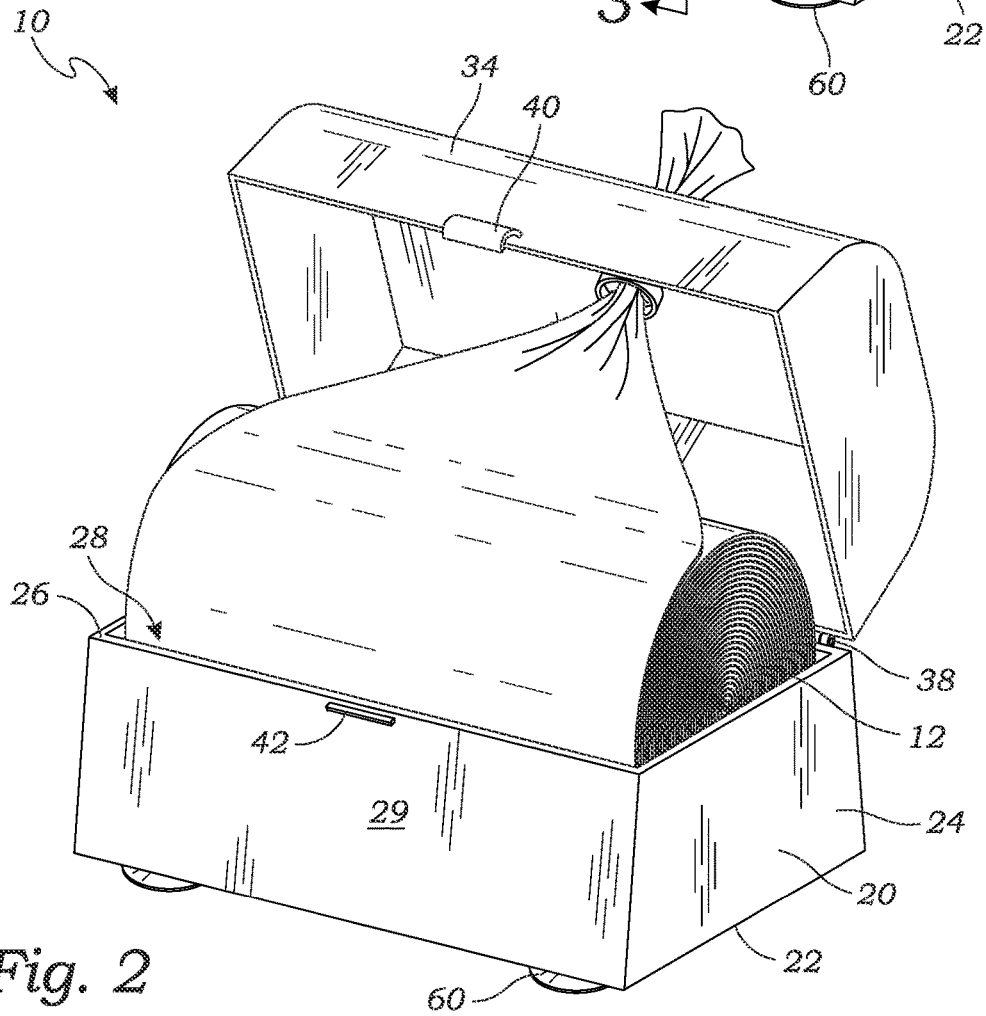
FIG. 2 is a perspective view illustrating the bin bag dispenser in an open position.
Figure 3:
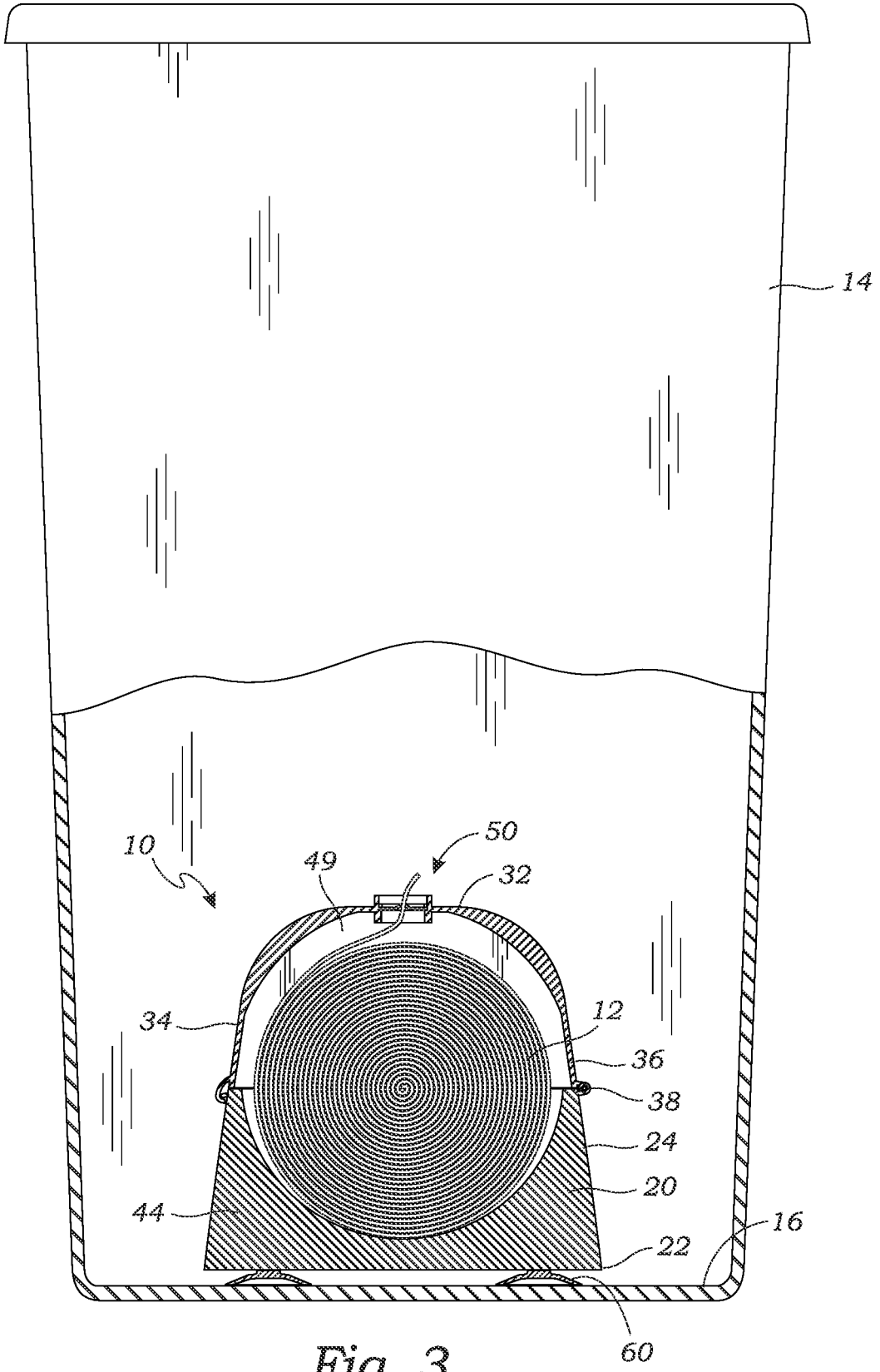
FIG. 3 is a side elevation view of the bin bag dispenser operably positioned in a trash bin, with a portion of the trash bin being broken away to illustrate the bin bag dispenser positioned within the trash bin.

FIG. 1 is a perspective view of a bin bag dispenser 10 according to one embodiment of the present invention, illustrating the bin bag dispenser 10 in a closed position. FIG. 2 is a perspective view illustrating the bin bag dispenser 10 in an open position, illustrating a trash bag roll 12 in the dispenser 10. FIG. 3 is a side elevation view of the bin bag dispenser operably positioned in a trash bin 14, with a portion of the trash bin 14 being broken away to illustrate the bin bag dispenser 10 positioned within the trash bin 14. The bin bag dispenser 10 is shown in a cross-section taken along lines 3-3 in FIG. 1.

As shown in FIGS. 1-3, the bin bag dispenser 10 includes a dispenser housing 20 having a housing base 22 and a housing wall 24 that extends upwardly from the housing base 22 to a perimeter 26, and the base 22 and wall 24 together form a chamber 28 for holding a trash bag roll 12. In this embodiment, the housing base 22 is a generally shaped like a rectangular cuboid, although any suitable shape for holding the trash bag roll 12 may be used.

In this embodiment, the dispenser housing 20 further includes a housing cover 30 that fits over the dispenser housing 20, abutting the perimeter 26, to cover the chamber 28. In this embodiment, the housing cover 30 having a top panel 32, a front surface 34, and a rear surface 36. A hinge 38 connects the housing cover 30 (in this case, the rear surface 36) to the dispenser housing 20. The hinge 38 enables the housing cover 30 to pivot between an open position shown in FIG. 2, and a closed position shown in FIG. 1.

A latch 40 on the front surface 34 of the housing cover 30 interlocks with a receiver 42 of a front surface 29 of the dispenser housing 20 to lock the housing cover 30 in the closed position. In this embodiment, the latch 40 is in the form of a resilient hook, and the receiver 42 is in the form of a ridge, but any number of mating latch mechanisms known in the art may be used, and should be considered within the scope of the present invention.

The dispenser housing 20 may further include at least one curved rib 44. In this embodiment, the dispenser housing 20 includes a plurality of curved ribs 44, each connecting the housing base 22 and the housing wall 24, each of the plurality of curved ribs 44 having a radius of curvature that is approximately equal to a radius of curvature of the trash bag roll 12, so that the trash bag roll 12 fits snugly on the ribs 44. Similar ribs 49 may be formed in the housing cover 30 as well, as shown in FIG. 3.

Figure 4:
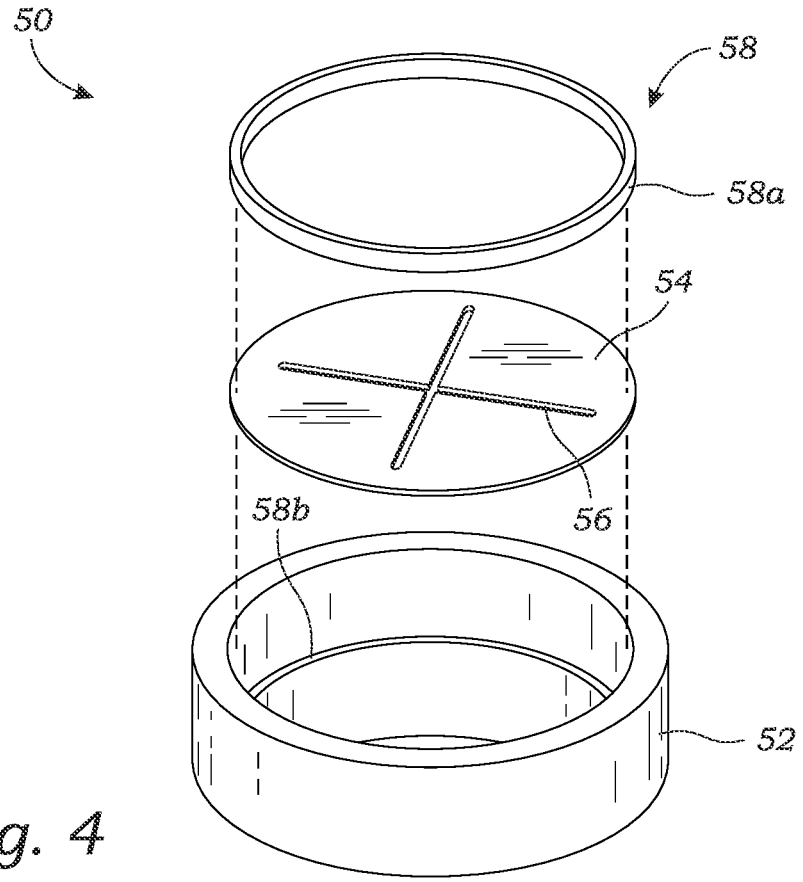
FIG. 4 is an exploded perspective view of a dispensing mechanism of the bin bag dispenser.

As shown in FIGS. 1-3, the bin bag dispenser 10 further includes a dispensing mechanism 50 mounting in the housing cover 30, in this case in the top panel 32, for dispensing individual bags from the trash bag roll 12. This is illustrated in FIG. 4, and is discussed in greater detail below. The bin bag dispenser 10 may further include a fastener 60 for removably fastening the dispenser housing 20 to a bottom 16 of the trash bin 14. In this case in the fastener 60 is in the form of a suction cup, but in alternative embodiments it may be any form of fastener known in the art, and alternative fasteners should be considered within the scope of the present invention.

FIG. 4 is an exploded perspective view of the dispensing mechanism 50 of the bin bag dispenser 10. As shown in FIG. 4, the dispensing mechanism 50 of this embodiment includes an annular retainer 52 fixedly mounted to the top panel 32 of the housing cover 30. The dispensing mechanism 50 further includes a resilient sheet 54 having a slit 56, and a means for mounting 58 the resilient sheet 54 within the annular retainer 52 so that trash bags from the trash bag roll may be dispensed though the slit 56 of the dispensing mechanism.

In this embodiment, the means for mounting 58 includes a retainer ring 58*a* that lockingly engages a step 58*b* in the annular retainer 52. The locking engagement may be achieved via a frictional locking, and or may include adhesives, heat welding, and/or any other locking mechanism known in the art. The means for mounting 58 may alternatively include any other forms of mounting known in the art, such as the use of mechanical fasteners, co-molding, wrapping the resilient sheet 54 around the annular retainer 52 and bonding or fastening the resilient sheet 54 to the retainer 52, and/or any other mechanism known in the art.

Figure 5:
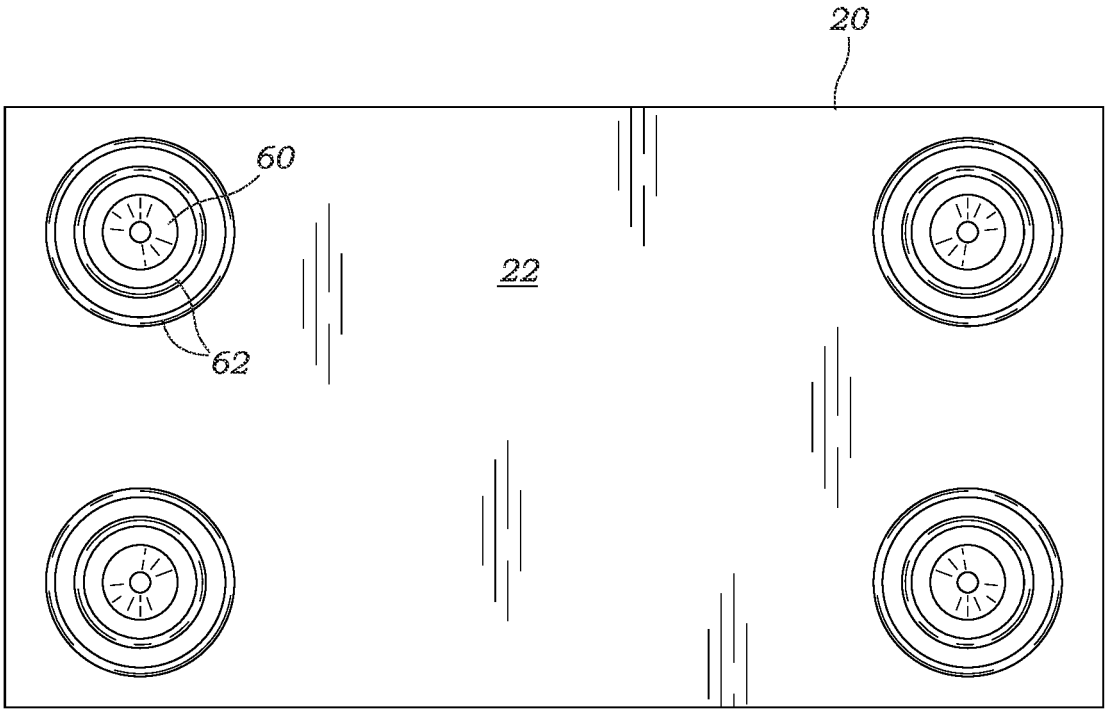
FIG. 5 is a bottom plan view of the bin bag dispenser.

FIG. 5 is a bottom plan view of the bin bag dispenser 10. As shown in FIG. 5, the bin bag dispenser 10 of this embodiment includes fasteners 60 at each corner of the housing 20. In this embodiment, each of the fasteners 60 is surrounded by a plurality of annular ridges 62 that extend upwardly from the housing base 22. In this case, there are at least two annular ridges 62 around each of the fasteners 60.

Figure 6:
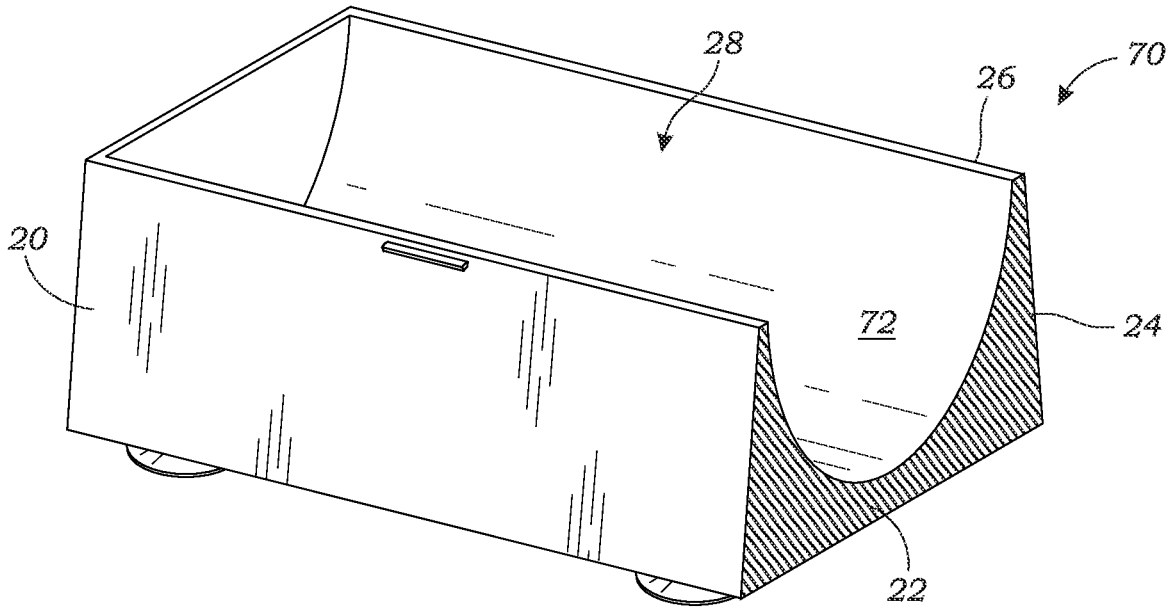
FIG. 6 is a perspective view of another embodiment of a dispenser housing, with a side of the dispenser housing broken away to illustrate the structure of a base of the dispenser housing.

FIG. 6 is a perspective view of another embodiment of a dispenser housing 70, with a side of the dispenser housing 70 broken away to illustrate the structure of a base of the dispenser housing 70. As shown in FIG. 6, in this embodiment the housing base 22 and the housing wall 24 form a U-shaped inner surface 72 that defines the chamber 28, and which provides the at least one rib discussed above. By extending the rib structure the entire length of the housing 70, from end to end, the roll of bin bags is more fully supported, so that the roll can rotate more easily, and so that there are no edges that might damage the roll of bags (e.g., tearing, etc.).

The title of the present application, and the claims presented, do not limit what may be claimed in the future, based upon and supported by the present application. Furthermore, any features shown in any of the drawings may be combined with any features from any other drawings to form an invention which may be claimed.

As used in this application, the words "a," "an," and "one" are defined to include one or more of the referenced item unless specifically stated otherwise. The terms "approximately" and "about" are defined to mean +/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A bin bag dispenser for holding a trash bag roll on a bottom of a trash bin, the bin bag dispenser comprising:

a dispenser housing having a housing base and a housing wall that extends upwardly from the housing base to form a chamber for holding the trash bag roll;

a housing cover that fits over the dispenser housing to cover the chamber, the housing cover having a top panel and a front surface;

further comprising a hinge that connects the housing cover to the dispenser housing, the hinge enabling the housing cover to pivot between an open position and a closed position; and a dispensing mechanism mounting in the top panel of the housing cover, the dispensing mechanism having an annular retainer fixedly mounted to the top panel, a resilient sheet having a slit, and a means for mounting the resilient sheet within the annular retainer so that trash bags from the trash bag roll may dispensed though the slit of the dispensing mechanism.

2. The bin bag dispenser of claim 1, further comprising a latch on the front surface of the housing cover, the latch interlocking with a receiver of a front surface of the dispenser housing to lock the housing cover in a closed position.

3. The bin bag dispenser of claim 1, a plurality of curved ribs each connecting the housing base and the housing wall, each of the plurality of curved ribs having a radius of curvature that is approximately equal to a radius of curvature of the trash bag roll.

4. The bin bag dispenser of claim 1, at least one curved rib each connecting the housing base and the housing wall, each of the at least one curved rib having a radius of curvature that is approximately equal to a radius of curvature of the trash bag roll.

5. The bin bag dispenser of claim 1, wherein the means for mounting includes a retainer ring that lockingly engages a step in the annular retainer.

* * * * *